US011243044B2

(12) United States Patent
Chia

(10) Patent No.: US 11,243,044 B2
(45) Date of Patent: Feb. 8, 2022

(54) SHORT PROJECTILE PISTOL WITH STORAGE HANDLE

(71) Applicant: Easebon Services Limited, Kwun Tong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 16/906,996

(22) Filed: Jun. 19, 2020

(65) Prior Publication Data

US 2021/0348876 A1 Nov. 11, 2021

Related U.S. Application Data

(60) Provisional application No. 63/020,086, filed on May 5, 2020.

(51) Int. Cl.
*F41B 7/08* (2006.01)
*F41A 9/66* (2006.01)
(Continued)

(52) U.S. Cl.
CPC ..... *F41B 7/08* (2013.01); *A63H 5/04* (2013.01); *F41A 9/66* (2013.01); *A63F 9/0278* (2013.01); *F41B 11/89* (2013.01)

(58) Field of Classification Search
CPC .. F41B 7/003; F41B 7/006; F41B 7/08; F41B 11/642; F41B 11/89; F41B 11/55
(Continued)

(56) References Cited

U.S. PATENT DOCUMENTS 2,562,462 A * 7/1951 Jackson ..... F41B 7/006 124/52
2,735,206 A * 2/1956 Butler et al. ..... F41A 9/65 42/18
(Continued)

FOREIGN PATENT DOCUMENTS

CN 208026132 U 10/2018
GB 616909 A 1/1949
(Continued)

OTHER PUBLICATIONS

International Search Report received for PCT Patent Application No. PCT/SG2021/050248 dated Jul. 30, 2021, 5 pages.
(Continued)

*Primary Examiner* — Alexander R Niconovich
(74) *Attorney, Agent, or Firm* — Amster, Rothstein & Ebenstein LLP

(57) ABSTRACT

A toy projectile launcher pistol having a handle with an internal projectile storage area; at least one pair of inwardly biased resilient flaps; an air piston assembly having a barrel and a plunger element; a sliding handle coupled to the barrel, the sliding handle and barrel being movable between a forward position and a backward position; a compression spring that biases the plunger element against a rear wall in the toy projectile launcher pistol; and a latching assembly that couples the plunger element to a trigger assembly when the sliding handle is moved to the backward position, and the trigger assembly, upon toggling, releasing the coupling of the latching assembly between the plunger element and the trigger assembly.

14 Claims, 9 Drawing Sheets

(51) Int. Cl.
*A63H 5/04* (2006.01)
*A63F 9/02* (2006.01)
*F41B 11/89* (2013.01)

(58) Field of Classification Search
USPC ..... 124/16, 27, 66, 52, 67
See application file for complete search history.

(56) References Cited

U.S. PATENT DOCUMENTS 2,830,570 A * 4/1958 Horowitz ..... F41B 7/006 124/52
3,895,459 A * 7/1975 Morrison ..... F41B 7/08 446/430
4,016,854 A * 4/1977 Lehman ..... F41B 7/08 124/27
4,289,109 A * 9/1981 D'Andrade ..... F41B 11/00 124/67
4,756,297 A * 7/1988 Sindel ..... F41B 11/642 124/67
4,843,751 A * 7/1989 Ferri ..... F41B 11/55 42/54
7,677,235 B2 * 3/2010 Zimmerman ..... F41B 11/89 124/66
7,686,003 B2 * 3/2010 Witzigreuter ..... F41B 11/55 124/65
7,726,293 B2 * 6/2010 Wei ..... F41B 11/723 124/74
8,176,907 B2 * 5/2012 Wei ..... F41B 11/723 124/53
8,402,956 B2 * 3/2013 Dakan ..... F41B 7/006 124/27
8,596,254 B2 * 12/2013 Brooks ..... F41B 7/006 124/52
8,720,426 B2 * 5/2014 Hadley ..... F41B 11/723 124/66
9,004,052 B1 * 4/2015 Poirier ..... F41B 7/08 124/27
9,027,541 B2 * 5/2015 Huebl ..... F41B 11/681 124/56
9,134,091 B2 * 9/2015 Busse ..... F41B 11/89
9,239,206 B1 * 1/2016 Nguyen ..... F41B 11/646
9,389,042 B1 * 7/2016 Clayton ..... F41B 11/642
9,958,230 B1 * 5/2018 Nugent ..... F41A 9/73
10,648,764 B2 * 5/2020 Spielberger ..... F41B 7/006
10,782,089 B1 * 9/2020 Hedeen, Jr ..... F41B 11/646
10,859,337 B1 * 12/2020 Bernal ..... F41B 7/08
10,907,929 B2 * 2/2021 Bernal ..... F41B 11/73
2009/0320817 A1 * 12/2009 Huang ..... F41B 11/56 124/53
2010/0147277 A1 * 6/2010 Zimmerman ..... F41A 9/25 124/56
2010/0282227 A1 * 11/2010 Vanek ..... A63H 33/18 124/27
2013/0239936 A1 * 9/2013 Victor ..... F41B 3/03 124/16
2014/0326228 A1 * 11/2014 Poirier ..... F41B 7/08 124/16
2015/0308782 A1 * 10/2015 Chia ..... F41B 11/641 124/78
2015/0316345 A1 * 11/2015 Brahler, II ..... F41B 11/723 124/73
2016/0238339 A1 * 8/2016 Mitchell ..... F42B 10/26
2018/0058799 A1 * 3/2018 Kawawaki ..... F42B 12/42

FOREIGN PATENT DOCUMENTS

GB 2 206 055 A 12/1988
JP 2003-322496 A 11/2003

OTHER PUBLICATIONS

Written Opinion received for PCT Patent Application No. PCT/SG2021/050248 dated Jul. 30, 2021, 7 pages.

* cited by examiner

SHORT PROJECTILE PISTOL WITH STORAGE HANDLE

CROSS-REFERENCE TO RELATED APPLICATION

The present application claims the benefit of and priority to U.S. Provisional Patent Application No. 63/020,086, filed on May 5, 2020, the entire contents of which are incorporated by reference herein

FIELD

The present invention is generally related to a toy projectile launcher, such as a toy pistol, gun, and the like, for launching toy projectiles, such as foam bullets, darts, balls, and the like, with a simplified construction for a projectile storage area that also serves as a handle of the launcher.

BACKGROUND

Traditional toy projectile launchers have utilized various forms of rifles, pistols, blasters, machine guns, and the like, for launching toy projectiles, such as foam balls, darts, to name a few. Such toy launchers have varied in size, power, storage capacity, to name a few. More specifically, toy launchers of foam projectiles-bullets (or "darts"), balls, and the like—have become ubiquitous. One standard for foam bullets has been marketed under the brand name Nerf® with a rubber tip and a foam body that totals approximately 71.5 mm in length. There have been various types of rifles, machine guns, and the like, that have been marketed for launching such foam projectiles.

In most cases, the launchers for these standard Nerf foam bullets have been large rifle-style launchers that can be inflexible and unwieldy during play. Accordingly, there has been a need for a more portable foam or plastic toy projectile launcher that provides for more flexible play without sacrificing launch velocity and accuracy.

SUMMARY

To address the above, the present invention is generally related to an improved toy launcher for launching a shorter foam bullet in the form of a pistol that utilizes a foam bullet storage area as the handle of the launcher. According to an exemplary embodiment of the present invention, an integral projectile storage area is incorporated in the handle of the launcher, thereby eliminating the need for a separate insertable clip, which then would negate the need for a double wall thickness, which, in turn, would make the handle grip thinner and therefore more user friendly. Advantageously, an effective, user-friendly, and high-performance blaster may be realized in a compact design for quick draw applications that, nevertheless, provides high velocity and accurate projectile launching.

Particularly, the present invention is directed to a toy launcher with a simple construction for an improved integrated launcher with a two-step loading/priming and firing mechanism that decreases the size of the launcher while realizing high launching force for compact projectiles.

According to an exemplary embodiment, the toy launcher incorporates a handle that houses a projectile storage area and a spring-loaded reciprocating cylindrical/air piston assembly that is configured to uncover an opening for loading the handle storage area in a first rearward priming movement via a corresponding rearward movement of a cocking slide by a user. The simplified construction with the reciprocating air piston assembly of the present invention significantly reduces size and material costs of the launcher in comparison to the conventional mechanisms.

In accordance with an embodiment of the present invention, a toy launcher for launching a projectile includes a handle housing an internal projectile storage area; a reciprocating air piston assembly with a barrel; a plunger element engaged with the barrel; a compression spring that biases the plunger element against a rear wall of the toy launcher; a sliding handle coupled to the barrel, the sliding handle being movable between a forward position and a backward position; a latching assembly that couples the plunger element to a trigger assembly when the sliding handle is moved to the backward position; and the trigger assembly that, upon toggling, releases the coupling of the latching assembly between the plunger element and the trigger assembly. A projectile is expelled from a launching barrel.

In embodiments, the toy launcher includes a coupling between the sliding handle and the barrel of the air piston assembly.

In embodiments, the barrel is movable to a backward position when the sliding handle is moved to the backward position.

In embodiments, the barrel, in the backward position, uncovers an opening to the internal projectile storage area for loading one or more projectiles therein.

In embodiments, a front portion of the barrel pushes the plunger element to compress the compression spring against the rear wall of the toy launcher when the sliding handle is moved to the backward position.

In embodiments, the internal projectile storage area includes a spring mechanism for advancing a loaded projectile into a priming position in front of the barrel in the backward position.

In embodiments, the internal projectile storage area includes one or more pairs of resilient (e.g., spring-loaded) flaps for aligning a topmost loaded projectile in the priming position in front of the barrel in the backward position.

In embodiments, the plunger element and the barrel form an internal air chamber when the sliding handle is moved from the backward position to the forward position.

In embodiments, the barrel pushes the loaded projectile in the priming position forward into a firing position inside the launch barrel.

In embodiments, the plunger element is pushed forward by the compression spring to expel the air from the internal air chamber through an air nozzle on a front end of the barrel behind the loaded projectile in the firing position when the coupling of the latching assembly between the plunger element and the trigger assembly is released.

In embodiments, in the firing position, the air nozzle on a front end of the air piston assembly is immediately adjacent the projectile which in turn is in the launching barrel.

In embodiments, the spring-loaded air piston assembly is substantially oval in cross-section to maximize volume of the internal air chamber without increasing the thickness or length of the toy launcher.

BRIEF DESCRIPTION OF THE DRAWINGS

Exemplary embodiments of the present invention will be described with references to the accompanying figures, wherein.

DETAILED DESCRIPTION

Figure 1A:
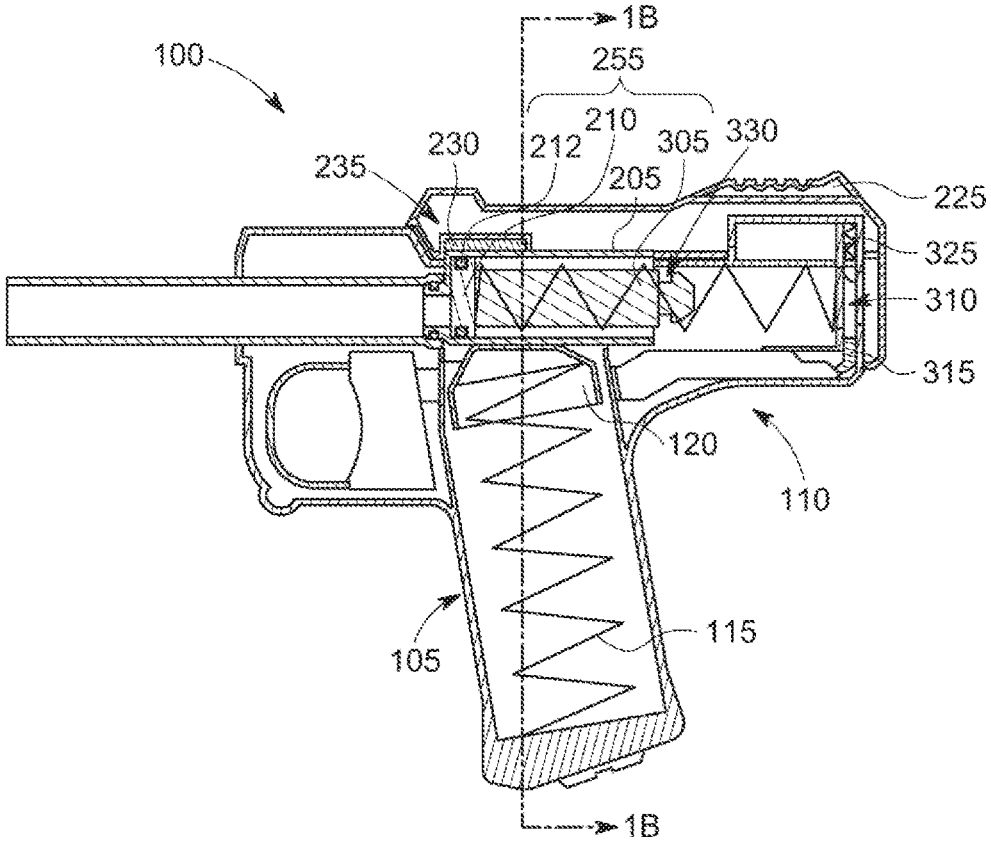
FIG. 1A is a schematic partial cross-sectional side view of key elements of a toy projectile launcher with an empty storage area in the handle according to an exemplary embodiment of the present invention.

The present invention is generally related to an improved toy launcher with a projectile storage area that also serves as a handle of the launcher. To achieve this objective, according to an exemplary embodiment, a toy launcher incorporates a spring-loaded storage area that is integral with and forms the handle of a launcher.

In the disclosure below, reference numerals with a trailing letter a or b denote elements on respective sides of toy launcher 100 and each of these elements have the same corresponding features but in mirrored arrangements in launcher 100.

Figure 1B:
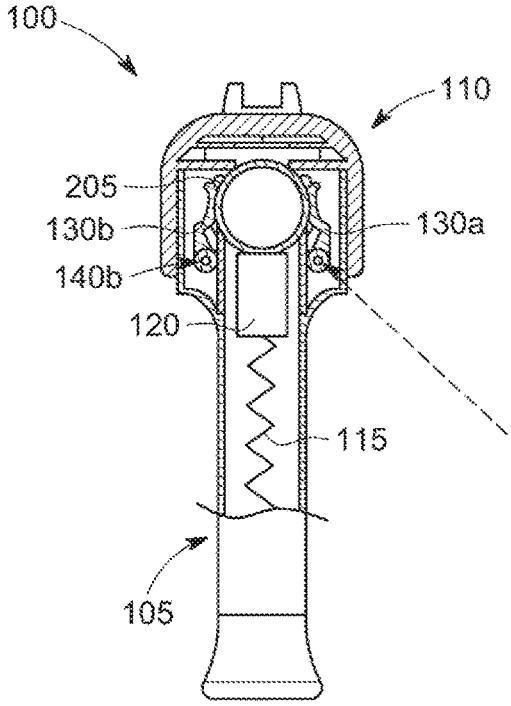
FIG. 1B is a schematic cross-sectional front view of the launcher along the 1B-1B line in FIG. 1A.

FIGS. 1A and 1B are schematic partial cross-sectional views of key elements of a toy projectile launcher 100 with an empty storage handle 105 according to an exemplary embodiment of the present invention. For clarity and simplicity in illustrating the key elements and mechanisms of toy projectile launcher 100 and storage handle 105, portions that are not necessary to understand the scope and the spirit of the present invention are not shown. One of ordinary skill in the art would readily understand the supporting elements needed to house and support the various illustrated elements including the spring-fed storage area in the handle 105 with various design choices that would not depart from the spirit and scope of the present invention.

FIG. 1A is a schematic side cross-sectional view of an empty storage handle 105 of a projectile launcher 100 in un-cocked position according to an exemplary embodiment of the present invention. As shown in FIG. 1A, projectile launcher 100 is shaped to resemble a pistol and handle 105 is shaped to resemble a pistol grip. In embodiments, launcher 100 may be in various other shapes and arrangements without departing from the spirit and the scope of the invention, as detailed below. As illustrated in FIG. 1A, a reciprocating air piston assembly 255 comprised of a barrel 205 and a plunger assembly 305 is located above and behind the handle 105 of the projectile launcher 100. As shown, a loading compression spring 115 of the empty storage handle 105 is in an expanded state where a pusher block 120 is pushed upward against the internal barrel 205, which, in the forward un-cocked position shown in FIG. 1A, covers a top opening of the empty storage handle 105. As described in further detail below, projectiles—such as foam darts/bullets, balls, and the like—would be advanced by spring 115 via block 120 such that a topmost projectile would be delivered to a loading position in launcher housing 110.

FIG. 1B is a schematic front cross-sectional view of launcher 100 along the 1B-1B line in FIG. 1A. As illustrated in FIG. 1B, block 120 abuts air piston barrel 205 at the top opening of the internal storage area of handle 105 when the internal storage area in handle 105 is empty. Additionally, the internal storage area of handle 105 includes a set of resilient side flaps 130*a* and 130*b*—which may be spring-loaded as described in further detail below—that, as described in further detail below, push inward against a projectile for alignment into a launch position. In the uncocked state shown in FIGS. 1A and 1B, the two side flaps 130*a* and 130*b* engage air piston barrel 205 on respective sides thereof.

Figure 1C:
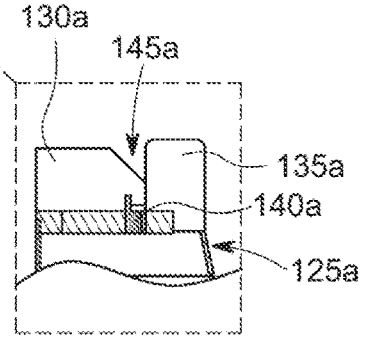
FIG. 1C is an inset closeup side view illustrating details of an assembly at the top portion of an internal storage area in the handle according to an exemplary embodiment of the present invention.

FIG. 1C is an inset closeup side view illustrating details of an assembly 125*a* at the top portion of the internal storage area of handle 105. As shown in FIG. 1C, assembly 125*a* includes spring-loaded flap 130*a* on a front portion (towards launch barrel 415 of launcher 100, see FIG. 3A) and a rigid frame 135*a* on a rear (or back) portion (towards the rear of launcher 100). As described in further detail below, rigid frame 135*a* (along with rigid frame 135*b* on the other side of launcher 100) have a generally rounded shape for fitting around the outer surface of 1 barrel 205 of air piston assembly 255 to serve as a movement guide for barrel 205 in the priming (cocking) process of launcher 100. FIG. 1C further illustrates a torsion spring 140*a* that exerts an inward force on flap 130*a* (and a similar spring exerts a corresponding force on flap 130*b*, not shown) so that the flap would be moved inward towards a loaded projectile, as will be described in further detail below. According to an exemplary embodiment of the present invention, flap 130*a* includes a slanted trailing edge 145*a* along which it may be pushed outward by barrel 205 when it is moved forward towards the position shown in FIG. 1A from a rearward priming (cocked) position, as described below and illustrated in FIG. 2A. Additionally, the slanted trailing edge 145*a* of flap 130*a*, along with a corresponding trailing edge of flap 130*b* (not shown), provide for loading projectiles into handle 105 by sliding said projectiles along the trailing edges to push flaps 130*a* and 130*b* outward, and to allow the projectiles to be inserted into the storage area of handle 105 (as described in further detail below and illustrated in FIG. 2C). In embodiments, flap 130*a* (and flap 130*b*) may be tapered outward towards the rear of launcher 100 for receiving, and for being pushed outward by, barrel 205 as it is moved forward towards the position shown in FIG. 1A from a rearward priming position described below and illustrated in FIG. 2A.

Figure 2A:
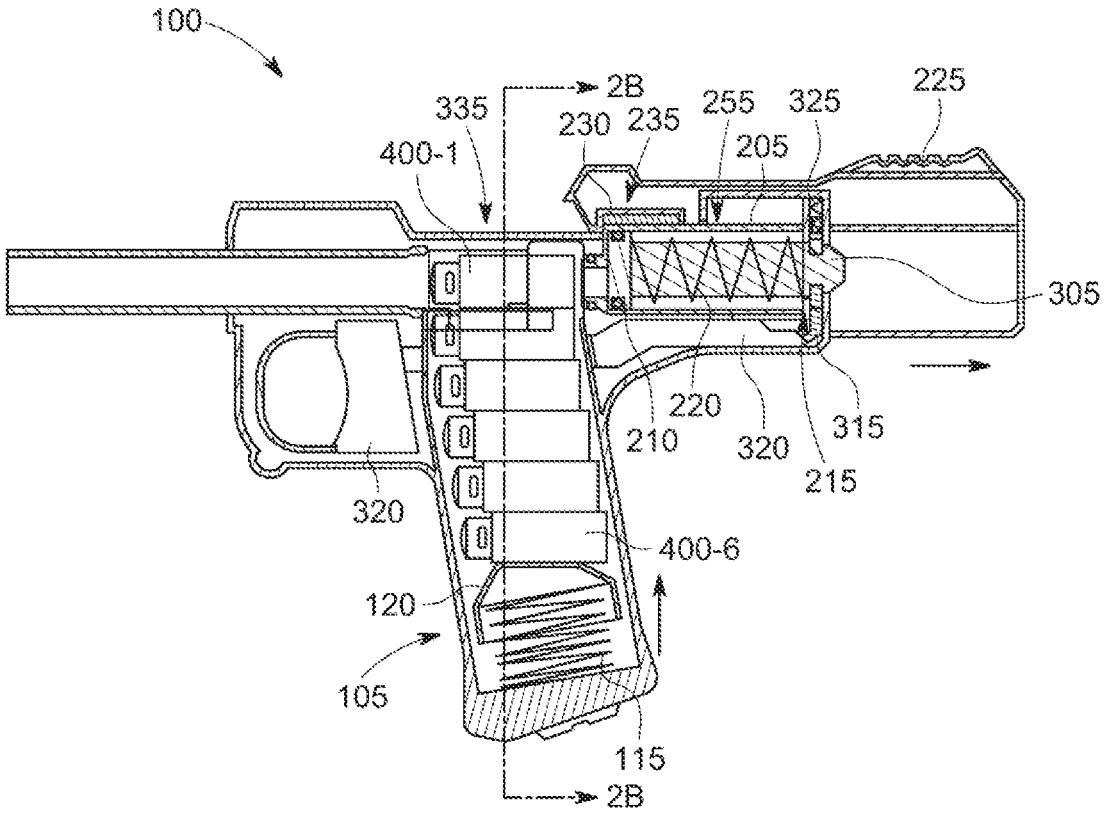
FIG. 2A is a schematic partial cross-sectional side view of a projectile launcher with a fully-loaded storage area in the handle of a projectile launcher in a rearward loading and priming (cocked) position according to an exemplary embodiment of the present invention.

FIG. 2A is a schematic side cross-sectional view of the fully loaded storage area in the handle 105 attached to projectile launcher 100 in a rearward priming and loading (cocked) position according to an exemplary embodiment of the present invention. As shown in FIG. 2A, toy launcher 100 includes barrel 205 with a plunger element 210 that form an air piston assembly 255. According to an exemplary embodiment, the barrel 205 of air piston assembly 255 has a generally rounded cylindrical or, as described in further detail below, oval shape and plunger element 210 is biased against a back wall 215 of the rear part of launcher housing 110 by a compression spring 220. The plunger element 210 incorporates a size and a shape that correspond with an internal circumference of barrel 205 so as to form an airtight seal with an internal surface of barrel 205. According to an exemplary embodiment of the invention, plunger element 210 incorporates a resilient O-ring 212 (FIG. 1A) to form an improved seal.

As illustrated in FIG. 2A, barrel 205 is coupled to a sliding top handle or cocking slide 225 via a projection 230 that is fittingly coupled to a recess 235 in cocking slide 225. The engagement between projection 230 on barrel 205 and recess 235 of cocking slide 225 allows a user to pull back barrel 205 and plunger element 210 in a first, pull-back, priming step. As shown in FIG. 2A, spring 220 is compressed between plunger element 210 and back wall 215. Advantageously, plunger element 210 starts at a position near a front portion of barrel 205, as shown in FIG. 1A, and, therefore, compression spring 220 may be fully compressed in the position illustrated in FIG. 2A. By providing such a longer compression distance to spring 220 (as opposed to compressing and decompressing spring 220 only in the rear portion of main housing 110 behind dart 400-1 shown in FIG. 2A), a lower rated and longer spring may be used without requiring additional length or space within housing 110 to provide, when released, sufficient forward force to launch darts 400 at a high velocity.

Figure 3A:
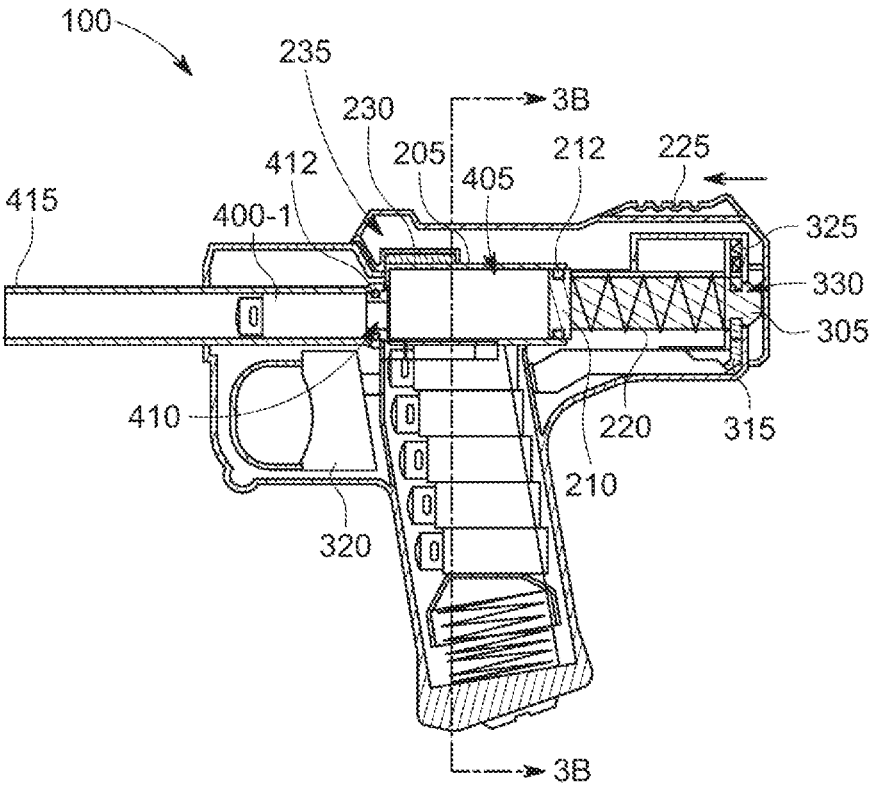
FIG. 3A is a schematic partial cross-sectional side view of a projectile launcher with a fully-loaded internal storage area in the handle of a projectile launcher in a forward firing position according to an exemplary embodiment of the present invention.
Figure 3B:
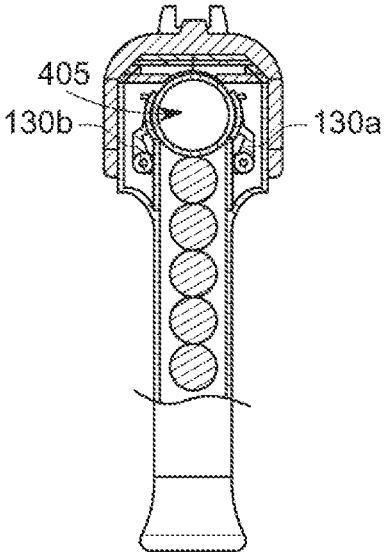
FIG. 3B is a schematic cross-sectional front view of launcher along the 3B-3B line in FIG. 3A.
Figure 3C:
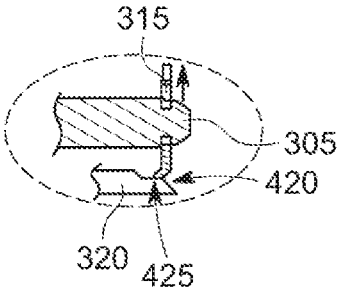
FIG. 3C is a closeup view of the interface between the rear portion of a trigger assembly and a plate when the trigger of the launcher is activated according to an exemplary embodiment of the present invention.

As will be described in further detail below with reference to FIGS. 3A and 3C, back wall 215 includes an aperture that allows a dome-shaped rod portion 305 to extend through and past another aperture 310 that is incorporated in a spring-loaded plate 315 that is, in turn, coupled to a trigger assembly 320 (see FIG. 1A). When a user pulls cocking slide 225 backward in a fashion similar to a cartridge-loaded pistol (see rearward arrow adjacent cocking slide 225 in FIG. 2A), a front back-facing surface of recess 235 pushes on a front-facing surface of projection 230 so that rod portion 305 is pushed back as well. As illustrated in FIG. 1A, plate 315 is coupled to a compression spring 325 that biases plate 315 downward towards a trigger assembly 320. According to an exemplary embodiment of the invention, the leading edge of dome-shaped rod portion 305 is rounded and when it is pushed backward, the rounded leading sloped edge pushes upward on a top edge of aperture 310 in plate 315, compressing spring 325, so that rod portion 305 can be pushed through aperture 310 from the front of plate 315 to clear an opposing back side of plate 315, as illustrated in FIGS. 1A, 2A, and 3A. Once rod portion 305 is pushed sufficiently past plate 315 through aperture 310, spring 325 moves plate 315 downward into engagement with a notch or recess 330 opposite the rounded face of rod portion 305 (see FIG. 1A) so that rod portion 305—and, correspondingly, plunger element 210—is engaged with, and temporarily retained in place by plate 315. As shown in FIG. 2A, the notch 330 hooks to the opposing back side of plat 315 above aperture 310 once plate 315 is pushed downwardly by compression spring 325 into notch 330 and, accordingly, a top edge of aperture 310 is pushed into a bottom surface of notch 330 (see FIGS. 1A and 2A)—thus, plate 315, compression spring 325, and notch 330 together form a latching assembly for holding rod portion 305 in the backward position.

As further shown in FIG. 2A and described above, with plunger element 210 being pulled back by rod portion 305, spring 220 is compressed against the back wall 215 of main launcher housing 110 in the position at which plate 315 and notch 330 are hooked and engaged with each other. In alternative embodiments, a structural stop (not shown) may be used to limit the backward motion of cocking slide 225 to the above full extension position—i.e., the engagement position between notch 330 and plate 315.

Correspondingly, with barrel 205 and cocking slide 225 moved back to the configuration shown in FIG. 2A, an opening 335 is created at a top portion of main housing 110, which opening 335 provides for loading of darts 400. As shown in FIG. 2A, a fully loaded launcher 100—for example, with six (6) darts 400-1 . . . 400-6—a top toy dart 400-1 in storage handle 105 is pushed upward and maintained in a priming position in front of barrel 205 in the internal chamber of launcher housing 110—by spring 115 and block 120 exerting an upward force on dart 400-6 and the other darts in storage handle 105. FIG. 2A illustrates a storage handle 105 with a capacity for six (6) foam darts but in embodiments, storage handles may have a different length and capacity for any number of darts 400-*n* up to a reasonable length so as not to render launcher 100 overly cumbersome.

Figure 2B:
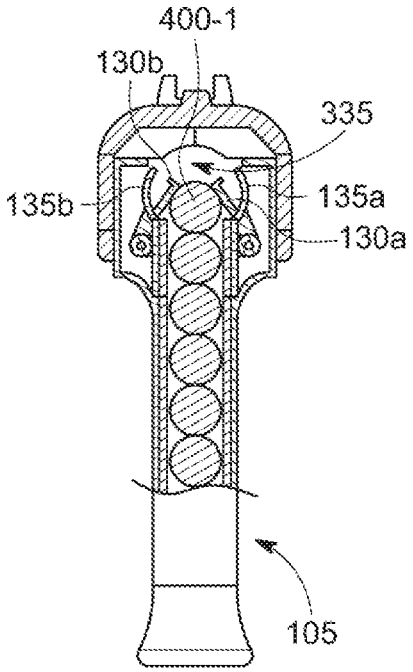
FIG. 2B is a schematic cross-sectional front view of launcher along the 2B-2B line in FIG. 2A.

FIG. 2B is a schematic front cross-sectional view of launcher 100 along the 2B-2B line in FIG. 2A. As illustrated in FIG. 2B, when the topmost foam dart 400-1 is in the internal chamber of launcher housing 110, the spring-loaded flaps 130*a* and 130*b* apply approximately equal inward force and approximately equal downward force so that dart 400-1 is held in place in an aligned priming position in front of barrel 205.

Figure 2C:
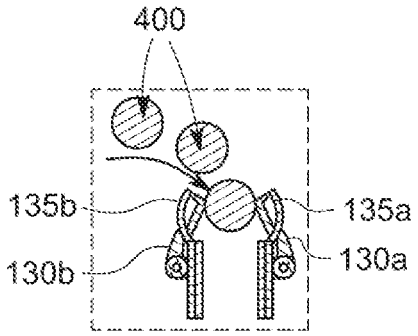
FIG. 2C is a partial cross-sectional front view of the top portion of the internal storage area to illustrate loading of the projectiles while in the loading (cocked) position shown in FIG. 2A.

FIG. 2C is a partial front cross section view of a top portion of the internal storage area (or cartridge) of handle 105 to illustrate loading of the projectiles—e.g., foam bullets/darts 400. As illustrated in FIG. 2C, flaps 130*a* and 130*b* may be moved outwardly to give way to darts 400 being loaded into the storage area of handle 105—for example, by pushing darts 400 against the trailing edges (145*a* shown in FIG. 1C) of flaps 130*a* and 130*b*. Again, once the darts 400 are loaded into the storage area of handle 105, flaps 130*a* and 130*b* apply inward and downward force on topmost dart 400-1 to hold the loaded darts 400 in place.

Referring now to FIG. 3A, with the notch/recess 330 of rod portion 305 engaged with plate 315 via the downward bias of spring 325, the user can push cocking slide 225 forward in a second priming step—again, in a similar fashion to a cartridge-loaded pistol—see forward arrow adjacent cocking slide 225 in FIG. 3A. Consequently, according to an exemplary embodiment of the present invention, a back wall of recess 235 engages the back wall of projection 230 during the forward motion of cocking slide 225. Thus, barrel 205 is compelled to slide forward towards the front of launcher 100 while rod portion 305 and plunger element 210 are held in place by plate 315. As shown in FIG. 3A, compression spring 220 remains fully compressed by the return of cocking slide 225 to its original forward position. Accordingly, plunger element 210 forms an air chamber 405 within barrel 205 whereby air is drawn in through a front nozzle 410 of barrel 205. In accordance with an exemplary embodiment of the present invention, nozzle 410 may be of a substantially smaller diameter than that of the air chamber 405 so that a forward push by plunger 210 would expel the air through nozzle 410 at a higher pressure. FIG. 3B is a schematic front cross-sectional view of launcher 100 along the 3B-3B line in FIG. 3A illustrating a cross section of air chamber 405 formed by air piston assembly 255.

As further shown in FIG. 3A, as the cocking slide 225 is moved forward in the direction shown by the forward arrow, the topmost dart 400-1 that is primed into the position in front of barrel 205 is pushed forward into launch barrel 415 in a firing position. According to an exemplary embodiment of the present invention, launch barrel 415 has an internal diameter that provides minimal clearance for darts 400 to allow for substantially airtight propulsion from launch barrel 415 upon release of the pressurized air from air cylinder assembly 255.

As illustrated in FIGS. 1A-3A, launch barrel 415 includes a rear portion that is of a slightly larger internal diameter for fittingly receiving front nozzle 410 of barrel 205, thereby, again, providing for a substantially airtight connection from air chamber 405 to the rear surface of dart 400-1 in the launch position within launch barrel 415. According to an exemplary embodiment of the present invention, nozzle 410 incorporates an O-ring 412 made from a resilient material, such as a polymer, around its outer circumference to form a seal around the internal circumference of the rear portion of launch barrel 415 to further improve the airtight connection.

Next, a trigger pull and launch action will be described. FIG. 3C is a closeup view of the interface between the rear portion of trigger assembly 320 and locking plate 315. As illustrated in FIG. 3C, trigger assembly 320 includes an inclined surface 420 and an upper surface 425—which collectively form a top camming surface of trigger assembly 320 so that, when trigger assembly 320 is pulled backward by the user, locking plate 315 is caused to move upward from inclined surface 420 to the upper surface 425 against spring 325. In embodiments, trigger assembly 320 may be biased forward in a default position by a spring (not shown), or the like, such that plate 315 returns to contacting the inclined surface 420 when trigger 320 is in the forward, default, non-firing position.

Figure 4:
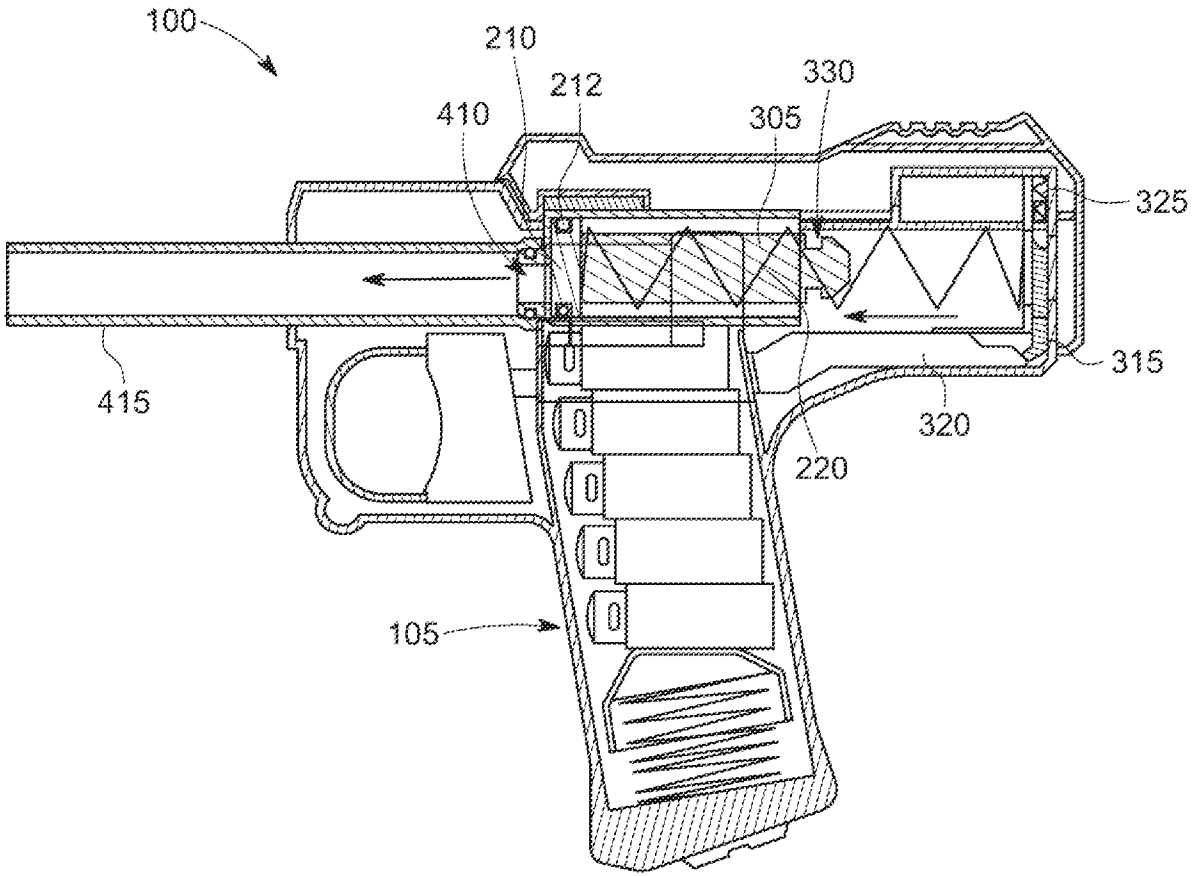
FIG. 4 is a schematic partial cross-sectional side view of a projectile launcher in a position after a first dart having been launched according to an exemplary embodiment of the present invention.

FIG. 3C, again, illustrates the configuration of the trigger pull according to an exemplary embodiment of the present invention. As shown in FIG. 3C, a user can pull trigger assembly 320 backward and, as trigger assembly 320 is slid backwards (see the extension element 320*b* of trigger assembly 320 that fits around storage (or cartridge) handle 105—to the rear portion with surfaces 420 and 425, i.e., the top camming surface—in the partial cross-sectional front view of FIG. 3D), inclined surface 420 is pushed backwards and, accordingly, slides plate 315 upward towards upper surface 425. Consequently, as plate 315 is pushed upward by the top camming surface (surfaces 420 and 425) of trigger assembly 320 (see upward arrow adjacent plate 315 in FIG. 3C), the engagement between plate 315 and notch/recess 330 of rod portion 305 is released as aperture 310 is moved upward to a position that clears notch/recess 330. Thus, as illustrated in FIG. 4, spring 220 is released from its fully compressed state thereby driving plunger element 210 and rod portion 305 forcefully forward (see forward arrow adjacent compression spring 220 in FIG. 4) to thereby expel the collected air from air chamber 405 through nozzle 410 to launch dart 400-1 through launch barrel 415. Correspondingly, trigger assembly 320 is returned to the forward default position and plate 315 is returned to its lowered position by compression spring 325. According to an exemplary embodiment of the present invention, cocking slide 225 may be pulled backward again to the position shown in FIG. 2A either to prime a next dart 400 from the storage handle 105 into the firing position shown in FIG. 3A or to load additional darts 400 into the storage handle 105 through opening 335 shown in FIG. 2A.

Figure 5:
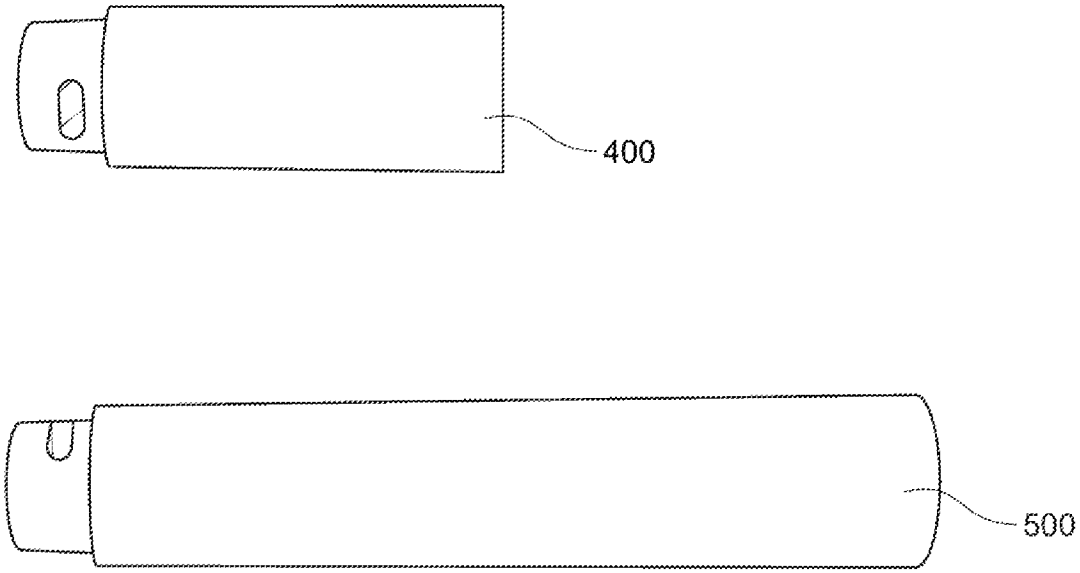
FIG. 5 is a drawing illustrating a comparison between a conventional foam dart that is 71.5 mm long and a foam dart that is 37.5 mm long for use with the storage handle in accordance with an exemplary embodiment of the present invention.

FIG. 5 is a drawing illustrating a comparison between a standard foam dart 500 that is 71.5 mm long and a foam dart 400 that is 37.5 mm long for use with the storage (or cartridge) handle 105 in accordance with an exemplary embodiment of the present invention. The shorter dart 400 contributes to the portability of launcher 100 and reduces the friction at the minimal clearance with launch barrel 415 described above, thereby also providing for higher velocity and accuracy using the air pressure launching mechanism described above. In embodiments, storage handle 105 may be incorporated in a rifle-style launcher for either short darts (400) or standard darts (500).

Figure 6:
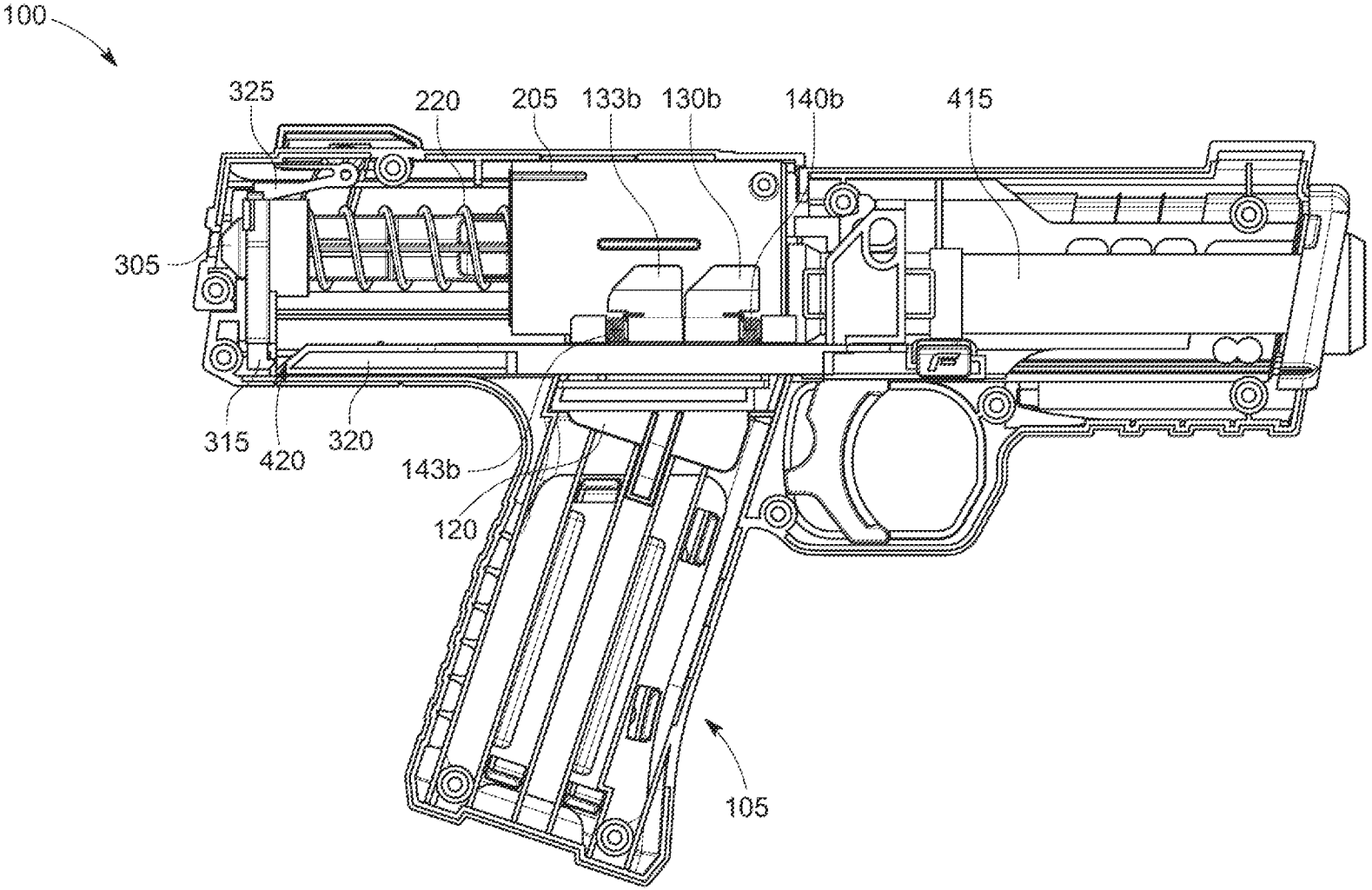
FIG. 6 is a schematic sectional side view of key elements of a toy projectile launcher with an empty storage area in the handle in correspondence the side view of FIG. 1A but from an opposite side and according to another exemplary embodiment of the present invention.

FIG. 6 is a schematic sectional side view of key elements of toy projectile launcher 100 with an empty storage area in the handle 105 in correspondence the side view of FIG. 1A but from an opposite side and according to another exemplary embodiment of the present invention. As shown in FIG. 6, the internal storage area of handle 105 of toy projectile launcher may include two pairs of spring-loaded side flaps 130*b* (along with 130*a* on the other side of launcher 100, as shown in FIG. 1A) and 133*b* (along with 133*a* on the other side, not shown). In this embodiment, spring-loaded side flaps 133*b* (and 133*a*) are disposed at the top portion of the storage area of handle 105 in place of rigid frame 135*a* (and 135*b*) illustrated in FIG. 1C. Similar to side flaps 130*a* and 130*b*, in the uncocked state shown in FIG. 6, the two side flaps 133*a* and 133*b* engage barrel 205 on respective sides thereof. Correspondingly, side flap 133*b* (and 133*a*) also incorporates a torsion spring 143*b* (and 143*a*) that exerts an inward force on flap 133*b* so that the flap would be moved inward towards a loaded projectile. Flap 133*b* (and 133*a*) also includes a slanted trailing edge (similar to 145*a* shown in FIG. 1C) along which it may be pushed outward by barrel 205 when it is moved forward towards the position shown in FIG. 6 from a rearward priming (cocked) position, as described above and illustrated in FIG. 2A. Additionally, this slanted trailing edge of flap 133*b*, along with a corresponding trailing edge of flap 133*a* (not shown), provide for loading projectiles into handle 105 by sliding said projectiles along the trailing edges to push flaps 133*a* and 133*b* outward, and to allow the projectiles to be inserted into the storage area of handle 105 in correspondence with flaps 130*a* and 130*b* described above.

According to an exemplary embodiment of the present invention, flaps 133*b* (and 133*a*) are incorporated in place of rigid frame 135*b* (and 135*a*) to address angling and/or misalignment of darts 400 that may occur when being pushed up into a priming position (in front of barrel 205 and nozzle 410 as shown in FIG. 2A) by spring 115 and block 120 from the storage area of handle 105. For example, with rigid frames 135*a* and 135*b*, the tail end of a dart 400 (e.g., 400-2) may sometimes rise above the front end of the dart 400 (e.g., 400-2) on a horizontal plane when it is pushed up into the priming position because rigid frames 135*a* and 135*b* would not contact such a dart 400 to keep it in place, as illustrated in FIG. 2C. Consequently, the forward motion of the barrel 205 and nozzle 410 may cause the dart 400 to jam—and not advance properly to the firing position in launch barrel 415 shown in FIG. 3A. It was also found that fusing flaps 130*a* and 130*b* with frames 135*a* and 135*b* together to form elongated flaps—similar to flaps 130*a* and 130*b* but extended to the positions corresponding to the rear ends of frames 135*a* and 135*b*—would leave space for the front end of a dart 400 to rise above the horizontal plane, and launcher 100 would, likewise, jam. Therefore, converting rigid frames 135*a* and 135*b* into hinged spring-loaded flaps 133*a* and 133*b* on the rear (or back) portion (towards the rear of launcher 100) at a top opening of the storage area improved reliability of toy launcher 100. Additionally, conventional magazine clips have two curved fixed arms similar to rigid frames 135*a* and 135*b*. For such rigid arms to contact and align a topmost dart 400 (e.g., 400-1 shown in FIG. 2*a*) in the priming position, barrel 205 would be obstructed and a push rod mechanism would be required, with the push rod being equal at least in length to the dart 400. Such a launcher would, therefore, need to be longer than launcher 100 by at least 37.5 mm—thus, rendering it cumbersome and unacceptable for the quick draw uses of launcher 100.

Thus, according to an exemplary embodiment of the present invention, the spring-loaded flaps 133*a* and 133*b* (in cooperation with flaps 130*a* and 130*b* described above with reference to FIGS. 2A and 2B) apply approximately equal inward force and approximately equal downward force so that a topmost dart or projectile 400-1 is held in place in an aligned priming position in front of barrel 205. Correspondingly, flaps 133*a* and 133*b* may be moved outwardly to give way to darts 400 being loaded into the storage area of handle 105—for example, by pushing darts 400 against the trailing edges of flaps 133*a* and 133*b*—in a similar manner with respect to flaps 130*a* and 130*b* described above with reference to FIG. 2C. Again, once the darts 400 are loaded into the storage area of handle 105, flaps 133*a* and 133*b* apply inward and downward forces on topmost dart 400-1 to hold the loaded darts 400 in place.

Figure 7A:
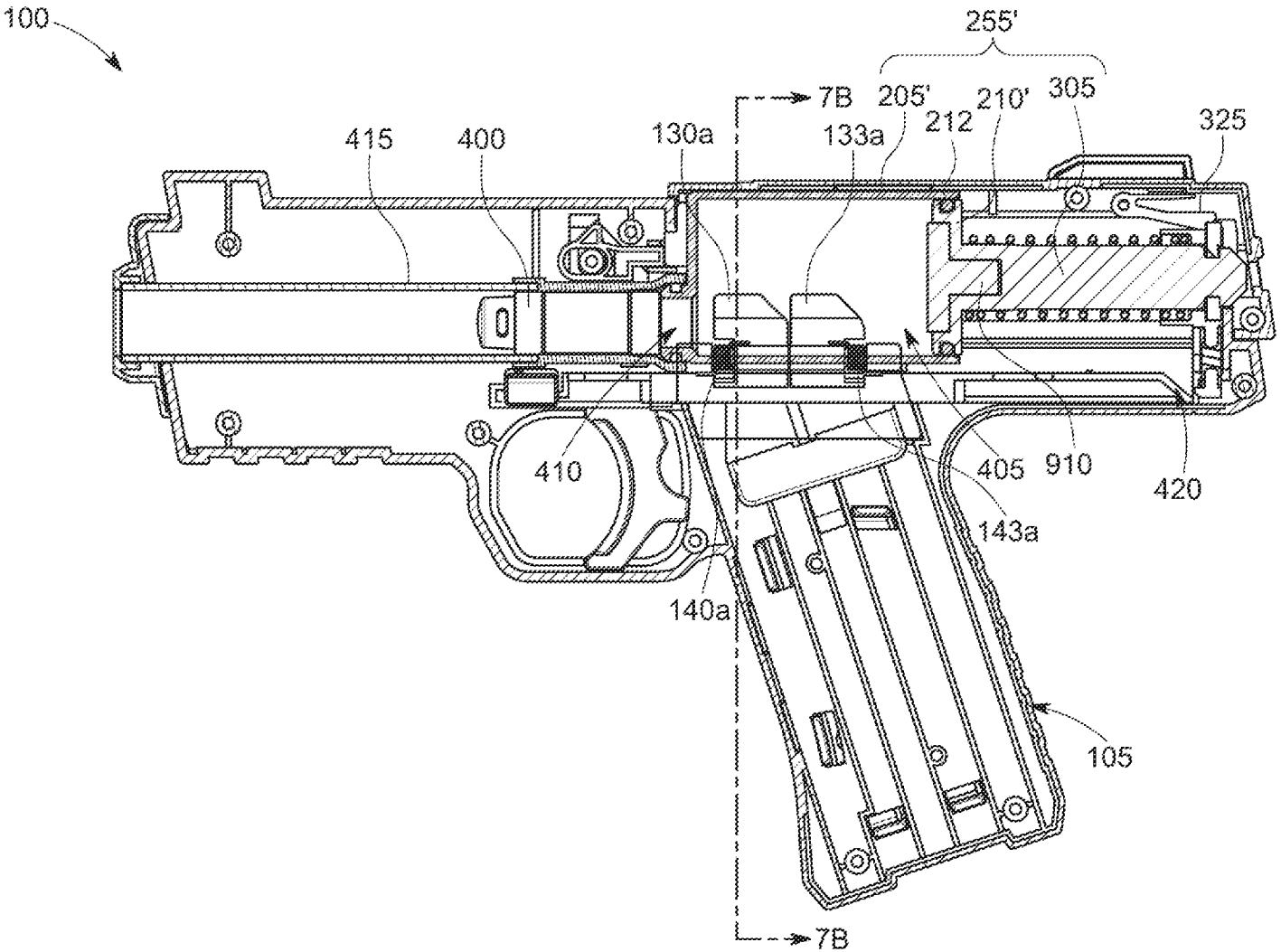
FIG. 7A is a schematic cross-sectional side view that corresponds to FIG. 6 of a projectile launcher with an empty internal storage area in the handle of a projectile launcher in a forward firing position with one dart primed in a firing position according to an exemplary embodiment of the present invention.
Figure 7C:
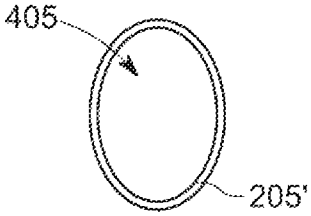
FIG. 7C is a closeup front partial cross-sectional view of an internal air cylinder of the launcher shown in FIGS. 7A and 7B according to an exemplary embodiment of the present invention.
Figure 7B:
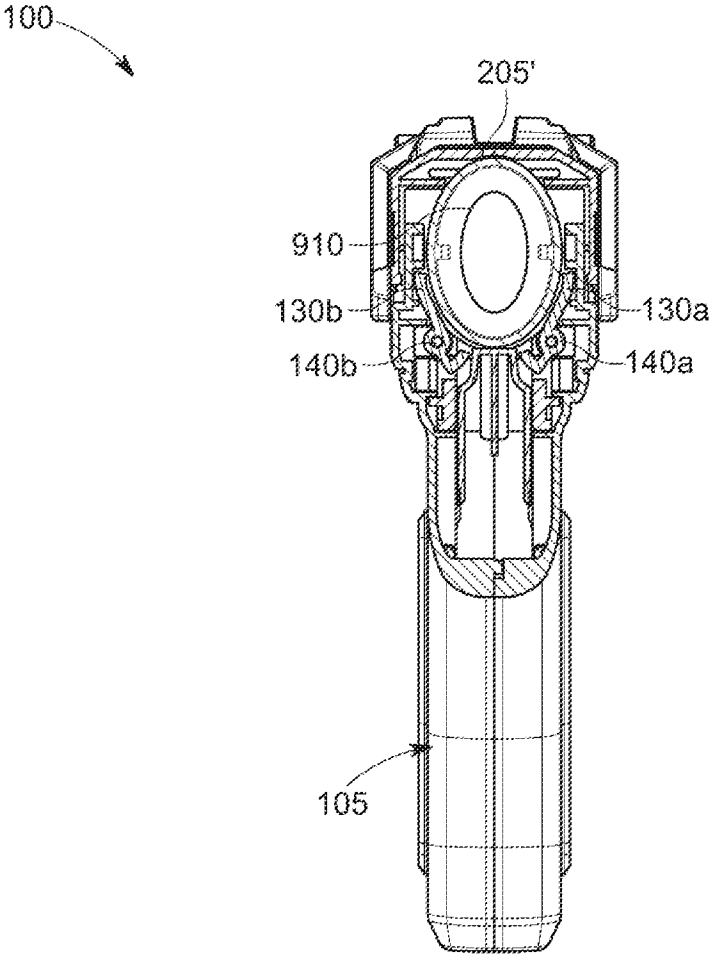
FIG. 7B is a schematic cross-sectional front view of launcher along the 7B-7B line in FIG. 7A.

In accordance with an exemplary embodiment of the present invention and as will be described in further detail below, barrel 205 may embody a larger internal volume for air chamber 405—thus increasing the launch force of launcher 100 on dart 400. As shown in FIG. 6, barrel 205 has an increased height when compared, for example, to launch barrel 415. For maintaining similar flexing ranges of spring-loaded flaps 130*a*, 130*b*, 133*a*, and 133*b* while increasing the internal volume for air chamber 405, internal air cylinder assembly 255 incorporates an elongated cross section in its height dimension—such as an oval shape as illustrated in FIGS. 7A-7C. Accordingly, internal air cylinder assembly 255 may maintain a similar width to, say, that shown in FIGS. 1B and 3B while increasing its height so that spring-loaded flaps 130*a*, 130*b*, 133*a*, and 133*b* need not flex to an unduly larger degree than shown in FIGS. 1B and 3B to accommodate the increased internal volume of air cylinder assembly 255.

As further illustrated in FIG. 6, trigger assembly 320 may merely incorporate an inclined surface 420 at its rear portion to serve as a camming surface (without a discrete upper surface 425 shown in FIG. 3C) so that as inclined surface 420 is pushed backwards, it slides plate 315 upward until the engagement between plate 315 and notch/recess 330 of rod portion 305 is released as aperture 310 is moved upward to a position that clears notch/recess 330. Additionally, spring 325 described above may be embodied by a spring-loaded arm or a leaf spring, as illustrated in FIG. 6, in an exemplary embodiment of the present invention.

FIG. 7A is a schematic side cross-sectional view of barrel 205' in launcher 100 that corresponds to the illustration in FIG. 6 according to another exemplary embodiment of the present invention. Like elements shown in FIGS. 7A, 7B, and 7C are denoted by the same reference numerals as those in FIGS. 1A to 6, detailed descriptions of which will not be repeated. FIG. 7A shows a cross section of air cylinder assembly 255' in launcher 100 from a side opposite to the side shown in FIG. 6 and, therefore, spring-loaded flaps 130*a* and 133*a*, along with torsion springs 140*a* and 143*a*, are shown in FIG. 9A in correspondence with spring-loaded flaps 130*b* and 133*b*, along with torsion springs 140*b* and 143*b*, shown in FIG. 6, respectively. Launcher 100, as shown in FIG. 7A, is in a firing position with a foam dart 400 primed in a firing position, which corresponds to the firing position shown in FIG. 3A of primed foam dart 400-1.

As illustrated in FIG. 7A, launcher 100 may incorporate an enlarged internal air cylinder assembly 255' that incorporates a substantially larger cross-sectional area than launch barrel 415 and, correspondingly, nozzle 410. As a result, a larger internal volume of air chamber 405 may be formed by air cylinder assembly 255' to provide for more compressed air and larger launch force on primed dart 400 through nozzle 410. In order to accommodate such a larger air cylinder assembly 255' without unduly increasing the bulk of launcher 100, air cylinder assembly 255' and barrel 205 incorporate a substantially oval shape, as illustrated in FIGS. 7B and 7C.

FIG. 7B is a schematic cross-sectional front view of launcher along the 7B-7B line in FIG. 7A; and FIG. 7C is a closeup front partial cross-sectional view of barrel 205' of the launcher 100 shown in FIGS. 7A and 7B according to an exemplary embodiment of the present invention. As illustrated in FIG. 7C, internal air cylinder assembly 255' may incorporate a 7:5 height-to-width ratio (35 mm:25 mm). Consequently, as shown in FIG. 7B, when air cylinder assembly 255' is in the forward firing position, spring-loaded side flaps 130*a* and 130*b* (and, correspondingly, spring-loaded side flaps 133*a* and 133*b* shown in FIGS. 6 and 7A, respectively) need not be unduly flexed outward to accommodate barrel 205', especially if compared with an air cylinder having a circular cross section that would achieve a similar internal volume. According to an exemplary embodiment of the invention, plunger element 210' is also substantially oval in shape with a resilient O-ring 212 to form an airtight seal with the substantially ovalshaped barrel 205'. As shown in FIGS. 7A and 7B, plunger element 210' may incorporate a center plug 910 to reinforce the structural integrity of plunger element 210' during launch. According to an exemplary embodiment, center plug 910 also has a substantially oval shape that corresponds to the shapes of barrel 205' and plunger element 210'.

Advantageously, as shown in FIGS. 7A and 7B, launcher 100 is capable of launching a short foam dart 400 with high velocity and accuracy while having a relative compact profile of a traditional pistol at approximately 236.73 mm in length and 153.63 mm in height.

Figure 8:
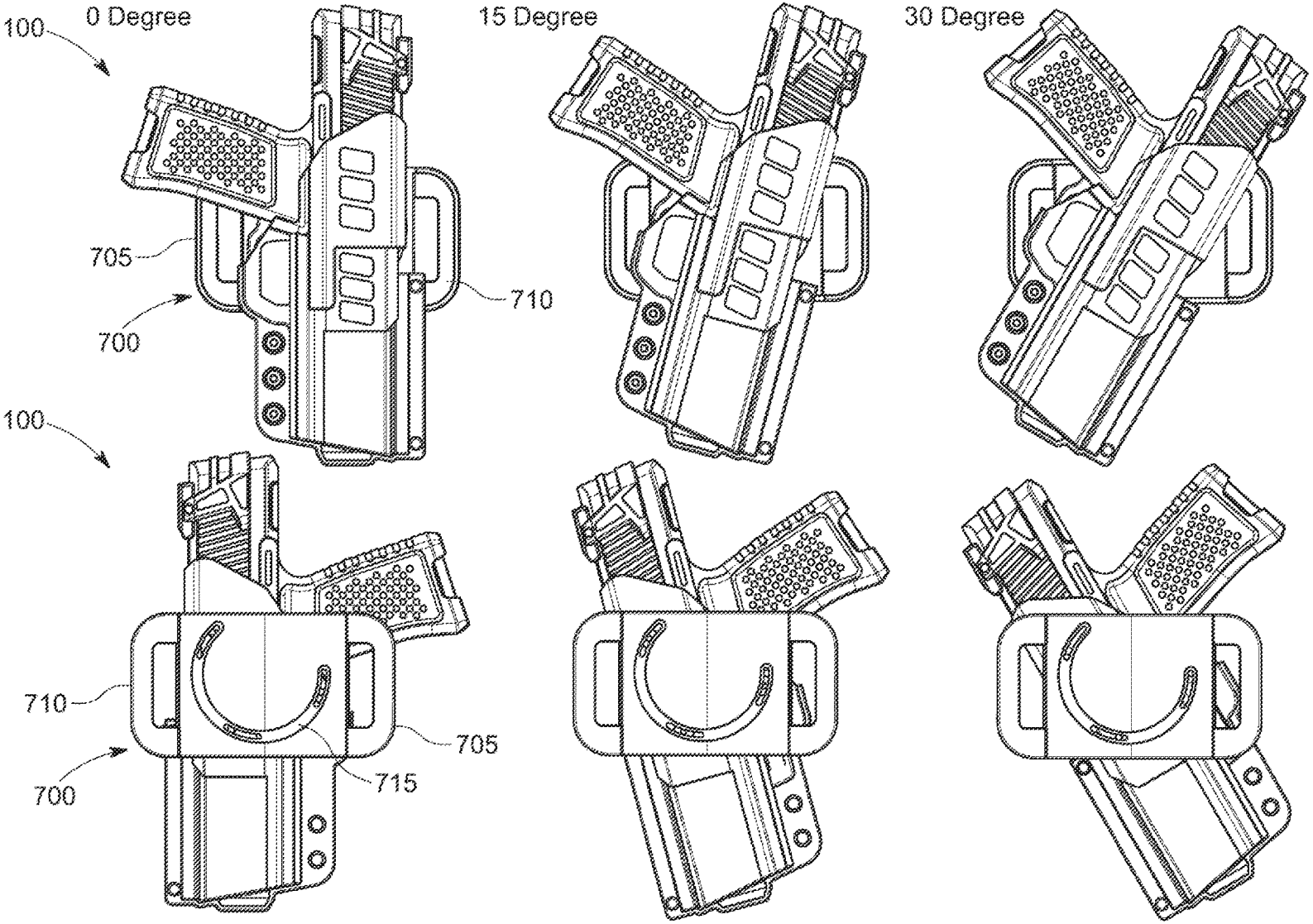
FIG. 8 includes a number of diagrams illustrating the toy projectile launcher being inserted and housed in a corresponding holster according to an exemplary embodiment of the present invention.

FIG. 8 includes a number of diagrams illustrating the toy projectile launcher 100 being inserted and housed in a corresponding holster 700 according to an exemplary embodiment of the present invention. Specifically, FIG. 8 illustrates a fitted holster 700 that includes a base having two loops 705 and 710 for receiving a belt, strap, harness, or the like (not shown) for fastening holster 700 to a user or the user's garment. As shown in FIG. 8, holster 700 is rotatable around its base along an arced track 715 so as to position launcher 100 at 0 degrees, 15 degrees, and 30 degrees, respectively. According to an exemplary embodiment of the present invention, holster 700 includes a locking mechanism (not shown) for fixing holster 700 to one of the three positions (0 degrees, 15 degrees, and 30 degrees)—or any position therebetween—according to a user's preference for quick draw play. Holster 700 may also be positioned beyond the 0 degrees and 30 degrees positions up to points where launcher 100 would not exit holster due to gravity.

Although the exemplary embodiment is described in the context of a foam bullet/dart launcher that utilizes shortened foam bullets/darts, it is to be understood that the two-step priming/loading and firing action according to the present invention could be applied to a toy projectile launcher of other types of projectiles (e.g. a ball or the like) or a fluid launcher whereby the fluid from a reservoir in the handle is driven by a plunger. In such environment the two-step priming/pumping action of the present invention enables a handheld high-velocity fluid burst launcher.

While particular embodiments of the present invention have been shown and described in detail, it would be obvious to those skilled in the art that various modifications and improvements thereon may be made without departing from the spirit and scope of the invention. It is therefore intended to cover all such modifications and improvements that are within the scope of this invention.

What is claimed is:

1. A toy projectile launcher, comprising:

a handle having a proximal end portion and a distal end portion, the handle defining an internal projectile storage area that extends from the proximal end portion of the handle to the distal end portion of the handle, and wherein the internal projectile storage area is configured to store at least one foam dart therein;

at least one pair of resilient flaps, the at least one pair of resilient flaps being inwardly biased and disposed on respective first and second sides at a top opening of the internal projectile storage area;

an air piston assembly that comprises a barrel and a plunger element;

a sliding handle coupled to the barrel, the sliding handle being movable between a forward position and a backward position, thereby moving the barrel between corresponding forward and backward positions;

a compression spring that biases the plunger element against a rear wall in the toy projectile launcher; and a latching assembly that couples the plunger element to a trigger assembly when the sliding handle is moved to the backward position and the barrel is moved to the corresponding backward position, wherein the barrel covers at least a portion of the top opening when in the corresponding forward position and the one or more pairs of resilient flaps contact the respective first and second sides of the barrel, the trigger assembly, upon toggling, releases the coupling of the latching assembly between the plunger element and the trigger assembly, and the projectile storage area is disposed at a rearward position on the launcher relative to a position of at least a portion of the trigger assembly.

2. The toy projectile launcher of claim 1, wherein the plunger element compresses the compression spring against the rear wall when the sliding handle is moved to the backward position.

3. The toy projectile launcher of claim 1, wherein a projectile from the internal projectile storage area is held between the at least one pair of resilient flaps when the barrel is moved to the corresponding backward position.

4. The toy projectile launcher of claim 1, wherein the sliding handle, when moved to the backward position, creates an opening in the toy projectile launcher for loading projectiles into the internal projectile storage area.

5. The toy projectile launcher of claim 1, wherein, when the sliding handle is moved from the backward position to the forward position with the latching assembly coupling the plunger element to the trigger assembly, the barrel is moved to the corresponding forward position and forms an internal air chamber with the plunger element, the internal air chamber being filled with air drawn in from a front nozzle of the barrel.

6. The toy projectile launcher of claim 5, wherein the plunger element is pushed forward by the compression spring to expel the air from the internal air chamber through the front nozzle of the barrel when the coupling of the latching assembly between the plunger element and the trigger assembly is released.

7. The toy projectile launcher of claim 5, further comprising a projectile in the internal air chamber immediately adjacent the front nozzle of the barrel.

8. The toy projectile launcher of claim 7, wherein the projectile has a firing position that is in front of the top opening of the storage area with the projectile forming a seal with the launch barrel.

9. The toy projectile launcher of claim 1, wherein the at least one pair of resilient flaps comprises a front pair of resilient flaps and a back pair of resilient flaps disposed at respective front and back portions of the top opening of the internal projectile storage area.

10. The toy projectile launcher of claim 9, wherein the barrel has an oval cross-section.

11. The toy projectile launcher of claim 10, wherein the oval shape of the barrel incorporates about a 7:5 height-to-width ratio.

12. A toy projectile launcher, comprising:

a handle having a proximal end portion and a distal end portion, the handle defining a projectile storage area, wherein the projectile storage area extends from the proximal end portion of the handle to the distal end portion of the handle, and wherein the projectile storage area is configured to store at least one foam dart therein;

a front pair of inwardly-biased resilient flaps disposed on respective first and second sides at a front portion of a top opening of the projectile storage area;

a rear pair of inwardly-biased resilient flaps disposed on the respective first and second sides at a rear portion of the top opening of the projectile storage area;

an oval-shaped air piston assembly that comprises a barrel and a plunger element;

a sliding handle coupled to the barrel, the sliding handle being movable between a forward position and a backward position, thereby moving the barrel between corresponding forward and backward positions;

a compression spring that biases the plunger element against a rear wall in the toy projectile launcher; and a latching assembly that couples the plunger element to a trigger assembly when the sliding handle is moved to the backward position and the barrel is moved to the corresponding backward position, wherein the barrel covers the top opening when in the corresponding forward position and the front and rear pairs of the inwardly-biased resilient flaps contact the respective first and second sides of the barrel, the trigger assembly, upon toggling, releases the coupling of the latching assembly between the plunger element and the trigger assembly, and the projectile storage area is disposed at a rearward position on the launcher relative to a position of at least a portion of the trigger assembly.

13. A toy projectile launcher, comprising:

a body and a handle, the handle having a proximal end portion and a distal end portion;

a projectile storage area defined by the handle, wherein the projectile storage area extends from the proximal end portion of the handle to the distal end portion of the handle and is in communication with the body, and wherein the projectile storage area is configured to store at least one foam dart therein;

an air piston assembly in the body, the air piston assembly comprising a barrel, a plunger element and a nozzle;

the barrel moveable relative to the plunger from an uncocked position to a cocked position wherein the nozzle is immediately adjacent the projectile storage area adjacent the body in the cocked position;

the projectile storage area is disposed at a rearward position on the launcher relative to a position of at least a portion of a trigger assembly of the launcher.

14. The toy projectile launcher of claim 13, wherein the air piston assembly has an oval shaped cross-section with a narrower side extending across a width of the body of the launcher.

* * * * *